United States Patent [19]

Kaye

[11] 4,022,585

[45] May 10, 1977

[54] METHOD FOR SEALING COMPOSITES AGAINST MOISTURE AND ARTICLES MADE THEREBY

[75] Inventor: Samuel Kaye, LaJolla, Calif.

[73] Assignee: General Dynamics Corporation, San Diego, Calif.

[22] Filed: Apr. 21, 1975

[21] Appl. No.: 570,144

[52] U.S. Cl. ..... 428/551; 204/30; 204/31; 204/37 R; 204/37 T; 204/38 S; 427/304; 427/322; 427/404; 427/431; 427/433

[51] Int. Cl.[2] ..... B23P 3/00; C25D 5/50; C25D 5/00; C25D 5/10

[58] Field of Search ..... 204/38 E, 30, 31, 37 R, 204/37 T, 38 B, 38 S; 427/290, 304, 306, 307, 322, 383, 404, 433, 430 R, 431; 29/195 P, 183.5

[56] References Cited

UNITED STATES PATENTS

| | | | |
|---|---|---|---|
| 3,416,992 | 12/1968 | Amos | 204/30 UX |
| 3,597,336 | 8/1971 | Shotton et al. | 204/30 |
| 3,709,727 | 1/1973 | Miller | 204/30 X |
| 3,892,883 | 7/1975 | Leclercq | 427/34 |

OTHER PUBLICATIONS

Industrial Finishing, pp. 56 & 58, Apr. 1968.

*Primary Examiner*—G. L. Kaplan
*Attorney, Agent, or Firm*—John R. Duncan

[57] ABSTRACT

A method for sealing and protecting the surface of advanced composite materials against moisture and other contaminants. Advanced composite materials, which comprise high strength fibers such as graphite or boron fibers in a resin matrix such as epoxy or polyimide resins, suffer a performance loss when subjected to moisture. In high vacuum environments, such as in many outer space applications, resin binder outgassing may cause contamination of the overall device. Significant dimensional changes occur when these composite structures are used in environments with widely varying humidity levels. The disclosed method of preventing such degradation basically comprises the steps of undercoating the surface with a metal coating, fluxing the undercoat, forming a layer of molten metal on the undercoat then solidifying the metal topcoating. A seal coating substantially impervious to water and highly resistant to dimensional changes and corrosion results.

17 Claims, 3 Drawing Figures

METHOD FOR SEALING COMPOSITES AGAINST MOISTURE AND ARTICLES MADE THEREBY

BACKGROUND OF THE INVENTION

This invention relates in general to advanced composite materials and, more specifically, to moisture-impervious coatings for such materials.

Advanced composite materials, which comprise very high strength fibers imbedded in a synthetic resin matrix, are coming into wide-spread use, especially in aerospace and sporting goods applications where high stiffness and a high strength-to-weight ratio are required. In many of these applications, dimensional stability of previously formed components is essential. Unfortunately, many of these composite materials exhibit significant dimensional instability when exposed to moisture, either directly as water or in high humidity environments. They also tend to contaminate high vacuum environments, such as space systems, due to outgassing.

A number of protective and moisture resistant coatings have been developed for various materials for different purposes. Synthetic resin coatings developed for moisture resistance are not truly impervious to moisture and tend to degrade in hostile environments. Combinations of resin coatings and electroplated metal films, such as are described by Robinson in U.S. Pat. No. 2,456,995 are resistant but not totally impervious to moisture, due apparently to "pinholes" or other paths through the coating. Similarly, sprayed metal coatings (such as are described by Luense in U.S. Pat. No. 1,261,141) and glow discharge deposited metal coatings (such as are described by Lindblom et al in U.S. Pat. No. 3,686,013) while moisture resistant are not totally impervious to moisture, apparently due to the fact that such coatings are slightly porous since they are composed of overlapping particles of metal which resist moisture only because of long vapor paths through thick coatings.

By forming a very thick metal coating by the above techniques, very high resistance to moisture can be obtained. However, such thick coatings add little to the strength of the substrate, while adding greatly to the weight. This would tend to defeat the purpose of the composite material, i.e., the high strength-to-weight ratio. This added weight is especially disadvantageous in aerospace applications.

Thus, there is a continuing need for a method of forming moisture impervious coatings over advanced composite materials without adding excessive weight to the composite article.

SUMMARY OF THE INVENTION

It is, therefore, an object of this invention to provide a method of forming a moisture impervious coating for composite materials which overcomes the above-noted problems.

Another object is to produce a thin, light-weight moisture impervious coating for composite materials.

A further object is to provide an effective corrosion preventing surface coating.

A still further object is to provide a surface coating for composite materials which prevents outgassing from the materials.

The above objects, and others, are accomplished in accordance with the present invention, by a coating and a method of forming a coating in which a thin metal undercoating is formed on an advanced composite structure, the undercoating is contacted with a fused metal at a temperature which does not damage the composite, the metal is allowed or caused to flow over the surface, then a thin layer of the fused metal is solidified by cooling. The result is a thin, lightweight, coating which is totally impervious to moisture penetration.

DETAILED DESCRIPTION OF THE INVENTION

The method and coating of this invention may be used with any suitable advanced composite or similar structure which is degraded by the presence of moisture, either directly or as a result of a high humidity environment. Typical composite materials include fibers such as graphite or boron imbedded in a matrix of a resin such as an epoxy, phenolic polysulfones or polyimide resin.

Preferably the composite surface is lightly abraded, such as by sandblasting or with fine sandpaper prior to application of the undercoat. Typically, the surface may be wet sanded with 320 paper, followed by "O" emery polishing paper used dry, or the surface may be abraded with glassbeads driven in a high velocity dry air stream.

Any suitable metal may be used for the undercoating, which is preferably applied by a combination of first electroless plating and then electrolytic plating. Typical undercoating metals include copper, nickel and silver. Best results are, in general, obtained with copper because copper coatings may be conveniently formed at low cost and have superior adhesion and flexibility. While the undercoating may have any suitable thickness, best results are obtained where the undercoating thickness is in the 0.00025 to 0.00035 inch range, which gives an optimum combination of light weight with low porosity.

The undercoating is then coated with a fused adherent metal by any suitable method. Two preferred methods comprise dipcoating with a suitable fuse metal, or electroplating a cover layer of metal or metals and fusing the layer in situ. In either case, the temperature of the fused metal must be below the temperature at which damage to the composite occurs.

Any suitable metal or combination of metals having the desired fusion temperature may be used. Typical metals include bismuth, lead, tin, cadmium, indium and eutectic alloys thereof. Cadmium generally is avoided where low vapor pressure is required. Best results are obtained with an eutectic fusible alloy consisting of 48–52 wt% indium and 52–48 wt% tin because of the low fusion temperature, excellent sealing, lack of toxicity, and low vapor pressure.

For substantially complete moisture resistance, with minimum weight, the top coat should have a thickness of from about 0.3 mil. to about 0.6 mil. Best results are obtained in the 0.2 to 0.3 thickness range.

Moisture sealing effectiveness has been found to depend markedly on adequate cleaning and/or fluxing of the undercoat surface prior to application of the top coat. In general, the inorganic fluxes of high chemical activity give best results. Typical of these fluxes are acids such as hydrochloric, hydrofluoric and orthophosphoric acids; salts such as zinc chloride, ammonium dichloride and tin chloride; and gases such as hydrogen chloride. Best overall results have been obtained by immersing the copper undercoated surface in a 1:4 aqueous hydrochloric acid solution. If the top coating is applied immediately after formation of the undercoating, extensive fluxing or cleaning between the steps may be omitted. A simple rinse to prevent carryover of solutions may be sufficient.

For dip coating, the cleaned undercoated surface is dipped into a molten metal bath having a protective cover layer of a material such as stearic acid. Repeated short dips are preferred to achieve a gradual temperature increase in the composite structure. If necessary, excess metal is removed and the surface leveled, such as by spraying with a hot oil or by rotating the structure at high speed to "sling" off excess fused metal by centrifugal force.

Where the sealing top coat is to be formed in situ, the metal layer is first coated over the undercoating by any suitable method, such as electroplating, flame spraying, etc. Where an eutectic alloy is desired, two or more metals may be applied simultaneously or in alternating thin layers. The surface is then heated above the melting point of the top coat, such as by dipping the assembly in a hot oil bath. Then the top coat is smoothed and leveled and excess metal is removed if necessary, such as by wiping or spinning the structure. The smoothing step assures uniform, sealing, coverage.

BRIEF DESCRIPTION OF THE DRAWING

Further details of the invention and of preferred embodiments thereof, will become apparent upon reference to the drawing, wherein.

DESCRIPTION OF PREFERRED EMBODIMENTS

Figure 1:
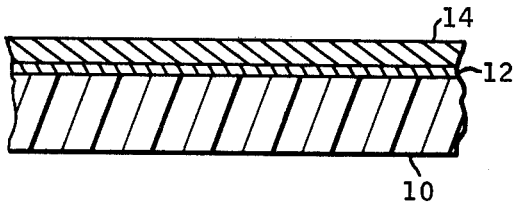
FIG. 1 is a cross-section through a composite structure protected by the surface coatings of this invention.

A number of preferred embodiments of the invention, as related to the drawing, are described in the drawing and the following examples.

Figure 2:
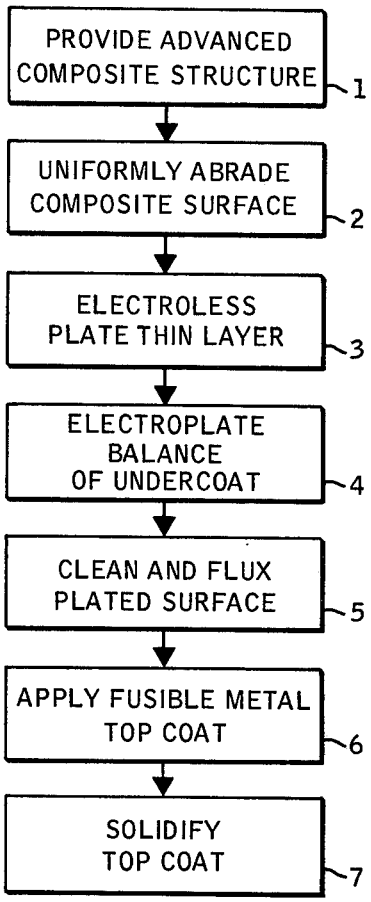
FIG. 2 is a block diagram illustrating the steps in a preferred method of forming the protective coating.

FIG. 1 illustrates a cross-section through a typical protected composite structure, produced by the method illustrated in FIG. 2. A composite structure 10 is prepared in any conventional manner, step 1. The surface of composite 10 is then uniformly finely abraded, step 2. In step 3 thin metal undercoat 12 is then formed on the surface of composite 10, such as by electroless plating. The electroless plated layer is formed to a thickness of a few mils, then the surface is rinsed and moved to an electrolytic plating bath where the layer (of the same metal) is built up to the desired thickness, in step 4, to complete the undercoat. The plated surface may then be carefully cleaned and/or a suitable flux applied in step 5. This step may be omitted in a continuous process where the top coating is applied immediately after formation of the undercoat. A top coating 14 of fusible metal is then applied in step 6 either by direct application of a fused metal or by fusing in situ a layer of metal formed by some other process, such as by electroplating. Finally, the fused metal layer is leveled, smoothed and cooled below the fusion temperature, step 7.

Figure 3:
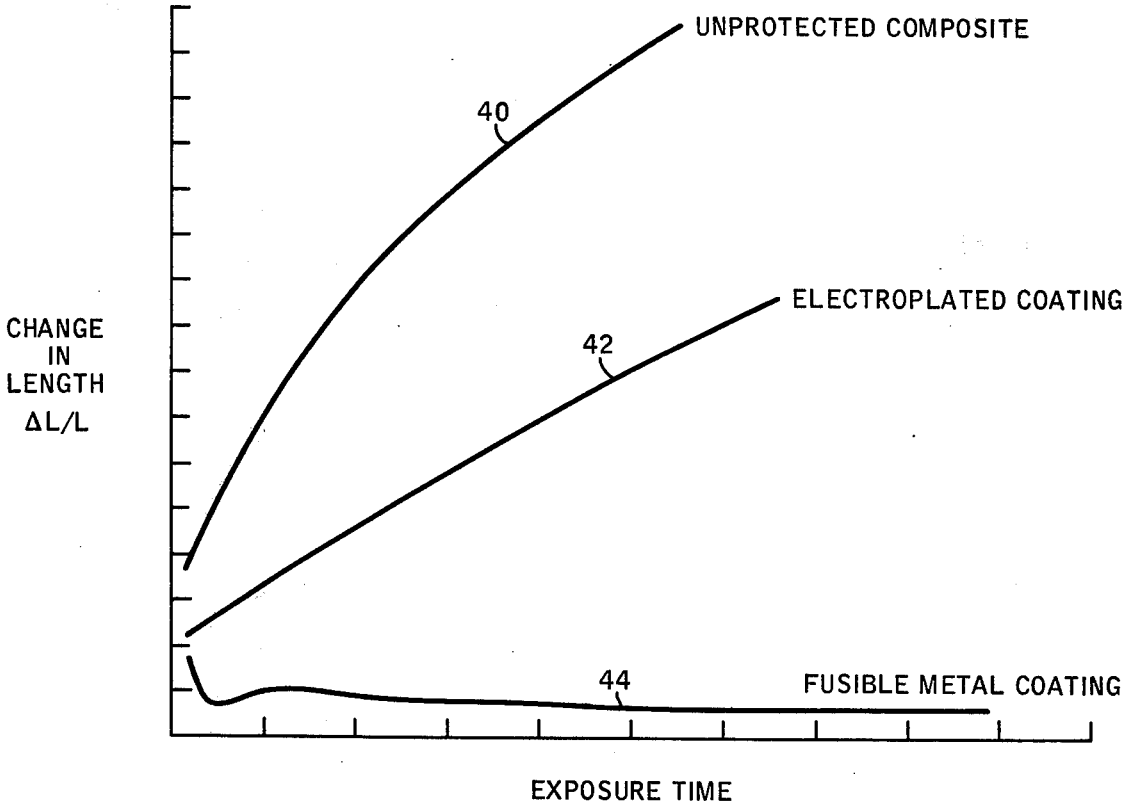
FIG. 3 is a diagram illustrating the effect of moisture on unprotected and protected composite structures.

FIG. 3 illustrates the relative moisture absorption of three composite surfaces, one unprotected, a second with an electroplated metal surface layer and a third protected by a coating prepared by the method of this invention. The tested structures are prepared as described in Example I, below. Dimensional change during testing is plotted along the ordinate and time in the 100% relative humidity environment is plotted along the abscissa. As can be seen from the curves, the unprotected composite surface 40 shows considerable dimensional growth when exposed to the high relative humidity environment. This change in size is unacceptable in precise, high tolerance systems. Curve 42, for a sample which has an entirely electroplated metal coating, shows some improvement but still demonstrates considerable moisture absorption. Curve 44 for a sample similar to that used for curve 42, but in which the electroplated layer is thinner and is coated with the fusible metal top coating demonstrates complete moisture resistance resulting in outstanding dimensional stability.

Further details of preferred methods are presented in the following examples. Parts and percentages are by weight unless otherwise indicated.

Example I

Three graphite-epoxy structures are each made by laminating seven 10 inch by 2.5 inch "prepreg" sheets of high Young's modulus graphite fibers in an epoxy vehicle, (Courtlands HM-S) together to produce an about 0.1 inch thick structure. Each sheet has a single layer of parallel contiguous graphite fibers. The sheets are cut and stacked so that the fibers are oriented at 0°, +45°, −45°, 90°, −45°, +45° and 0°, where the long dimension of the sheet is the 0° line. The resulting pseudoisotropic arrangement produces a structure having substantially equal strength in all directions in the plane of the structure surface. The stacked sheets are pressed between flat steel plates and curing the epoxy resin is completed by heating the assembly for about 2 hours at about 150° F.

One of the three structures is set aside for testing as described below, and the other two are prepared for overcoating. Each of the two structures is abraded by bombardment with about 36 micron glass beads driven in a dry air stream until the originally shining surface is uniformly dull.

The two structures are cleaned by dipping in a detergent solution consisting of 12 ounces of "Neutraclean," (a detergent available from Shipley, Inc.) per gallon of deionized water at about 140° F for about 10 minutes. The structures are then given a quick dip and spray rinse in deionized water at room temperature and a quick rinse in a solution of about 25 ounces hydrochloric acid in about a gallon of deionized water at room temperature.

A very thin layer of copper is formed over the surface of the two structures by passing them through the following series of treating baths. The structures are first immersed in an activator bath consisting of about 12 gal. of hydrochloric acid, about 15 gal. Activator 9070, a solution of palladious and stannous chlorides, from the MacDermid Company and about 33 gal. deionized water for about 20 minutes at about 80° F. The structures are removed and placed in an accelerator bath consisting of about 6 gal. Accelerator 9071, a hydrochloric acid solution from the MacDermid Company and about 54 gal. deionized water for about 10 minutes at about 80° F. Finally, the structures are placed in an electroless plating bath consisting of about 6 gal. Copper Part 22A, a copper sulfate solution from Hatch, Inc. and about 6 gal. Reducer Part 22B, a reducing agent solution from Hatch, Inc., and about 48 gal. deionized water, for about 15 min. at about 80° F. a thin uniform copper coating is formed.

The structures are dipped and rinsed in the deionized water and hydrochloric acid rinse solutions described above, then are electroplated with copper to form a thicker copper layer. The structures are placed in a bath consisting of about 6.3 gal. copper phosphate C-11-XB from M & T Chemicals, about 6.0 gal. copper phosphate C-10-XB from M & T Chemicals, about 1 gal. ammonium hydroxide and about 110 gal. deionized water at about 130° F. The structures are connected to a power supply and a current density of about 20 amps/ft$^2$ is imposed. After about 20 min. the copper layer has a thickness of about 0.00035 inch At the time one structure is removed and the second is left in the bath until the copper layer reaches a thickness of about 0.6 mil. This structure is then removed, rinsed with water and placed with the first, uncoated, structure.

The third structure sample (having the 0.00035 inch copper layer) is rinsed with water, placed in the "Neutraclean" detergent solution described above for about 3 minutes, is again rinsed with deionized water, and is then ready for coating with the fusible metal. A very thin (about 0.00002 inch layer) layer of tin is first formed over the copper layer by dipping the structure in a solution of about 75 gal. of a tin salt solution available from Shipley Chemicals under the Cuposit LT-26 trademark, about 3 gal. hydrochloric acid and about 51 gal. deionized water at about 160° F. The structure is removed, rinsed in warm (about 140° F) water, then is oven dried at about 150° F. To assure complete removal of all moisture, the structure is then dried in a vacuum of about 28 in. of mercury at about 150° for about 10 hours.

While unnecessary where the surface of the structure is still very clean, preferably the structure is fluxed by spraying the surface with fusing fluid, available from Hollis Engineering, Inc. under the trademark Hollis No. 225.

A bath is prepared consisting of about 52 wt% indium and about 48 wt% tin at about 270° F, with a layer of molten stearic acid over the metal mixture. The structure is immersed in the molten metal through the stearic acid and allowed to reach equilibrium temperature. The structure is then removed and spun to remove excess fused metal by centrifugal force. The spinning or "slinging" operation is adjusted so that, as the metal hardens, the total metal coating thickness on the structure is about 0.6 mil. The structure is finally cleaned by vapor degreasing with 1,1,1,-trichloroethane vapor 160° to remove solidified stearic acid from the surface.

The three samples, including the first uncoated structure, the second structure having a 0.6 mil electroplated copper layer and the third structure have the copper and fusible metal layer having a combined thickness of about 0.6, are all placed in a 100% relative humidity chamber at 120° F. Prior to exposure, and from time to time during exposure, the dimensions of the three samples are measured to an accuracy of about $\pm 1 = 10^{-8}$ inch. As is known, moisture absorption in composite structures causes considerable elongation of the structure. Elongation is plotted against time exposed to high humidity in FIG. 1 of the drawing for each of the three samples. It is apparent that the fusible metal coating substantially entirely prevents moisture absorption. While the electroplated coating makes the structures somewhat moisture resistant, apparently in time the elongation will reach that of the unprotected sample.

Example II

A sample consisting of graphite fibers in an epoxy resin matrix is treated as described in Example I up to the step of dipping the sample into a molten tin/indium bath. Instead of directly contacting the undercoated surface with a fused eutectic mixture of indium and tin, layers of indium and tin are applied by sequential electroplating, then the layers are fused in situ.

The structure, with a clean copper undercoat formed as described in Example I, is placed in a fluoroborate solution bath consisting of about 27 oz./gal. tin-fluoroborate, about 7 oz./gal. fluoroboric acid, about 4 oz./gal. boric acid and about 0.13 oz./gal. beta-napthol and about 0.8 oz./gal. gelatin in water. Tin is plated onto the copper undercoat at a current density of about 30 amps/ft$^2$ at room temperature with a 5 in. by ¾ in. by 1/16 in. tin sheet anode, with back-and-forth oscillation of the structure during plating to agitate the solution. Plating is continued until a 0.2 mil. thick layer is produced. The structure is then rinsed with deionized water and placed in an indium sulfamate plating bath, available from Indium Corporation of America. Indium is placed onto the tin layer at current density of about 20 amps/ft$^2$ at room temperature, using a 5 in. by ¾ in. by 1/16 in. indium anode. The structure is oscillated during plating to agitate the plating solution. Plating is continued until a 0.2 mil. layer of indium is formed.

The plated structure is rinsed in deionized water and dipped in oil at 280° F until the tin and indium layers fuse and reflow. The structure is removed from the oil, cooled to room temperature to solidify the tin-indium layer and cleaned of any residual oil. Microscopic examination at 80 ×shows the metal surface to be smooth and continuous. Testing in a 100% relative humidity atmosphere for two weeks show no moisture absorption, with only a 0.6% weight increase due to slight corrosion of the exposed metal surface.

EXAMPLE III

A structure is prepared as described in Example I up through the step of forming the copper undercoat. The copper surface is cleaned and the structure is immersed in a tin plating bath consisting of a solution of 10.6 oz./gal. potassium stannate and 4.0 oz./gal. potassium hydroxide. Tin is plated onto the copper surface using a 4 in. by 1 in. by 1/16 in. tin anode at a current density of about 25 amps/ft$^2$. Plating is continued until an about 0.05 mil. tin layer is formed. The structure is removed, rinsed and placed in an indium plating both consisting of a Rhondium plating solution available from Tivian Laboratories under the tradename Tivalite. Indium is placed onto the tin surface using a 4 in. by 1 in. by 1/16 indium anode at a current density of about 75 amps/ft$^2$. Plating is continued until an about 0.05 mil. indium layer is fromed. The above tin and indium plating steps are repeated until 6 layers of tin and 5 layers of indium are formed. The plate structure is then dipped in a stearic acid bath at about 275° F until the plated surface fuses. The structure is removed, cooled to room temperature, cleaned and exposed to 100% relative humidity for 2 weeks. Tests indicate substantially complete resistance to moisture.

EXAMPLE IV

A cylindrical, rod shaped composite structure is prepared by placing in a mold a quantity of Type A graphite filaments preimpregnated with an epoxy resin (available from the Fiberite Company under the X 505 designation) in the form of continuing tow. The tow has all fibers substantially parallel to the axis of the cylinder. The resin is cured for about 30 minutes at about 250° F under a pressure of about 50 psi.

The surface of the resulting cylinder is lightly abraded with 320, then 600 wet-or-dry sandpaper, used wet with water, until the surface is uniformly dull. The surface is cleaned with a detergent solution, rinsed with deionized water and dried.

The structure is then placed in a vacuum evaporation chamber and a very thin (less than about 0.0003 mil.) layer of silver is applied in a conventional manner, moving the cylinder and/or course during deposition to assure a substantially uniform coating.

Immediately upon removal from the vacuum evaporaton chamber, the surface is dipped in a flux solution consisting of dilute nitric acid. Then it is sprayed with a fused mixture of 49.0 wt% bismuth, 18.0 wt% lead, 12.0 wt% tin, and 21.0 wt% indium at about 175° F. The structure is placed in a fixture and rapidly rotated about a point along the cylindrical axis, about 2 feet beyond the end of the structure to remove excess fused metal and leave a surface coating of about 0.3 mil. The structure is then cooled to room temperature. Moisture resistance tests show that the coating is substantially impervious to moisture.

EXAMPLE V

A set of prepreg sheets are prepared by arranging 0.004 inch diameter silicon carbide coated boron fibers, available under the "Borsic" trademark from the Hamilton-Standard Division of United Aircraft in a parallel single layer contiguous sheet arrangement and impregnating the fiber sheet with Monsanto's RS-6234 polyimide resin. The prepreg sheets are wrapped around a collapsible cylindrical mold surface and the assembly is wrapped with a flexible outer sheet. The assembly is placed in an autoclave and the resin is cured for about 2 hours at about 350° F under about 40 psig pressure. The mold is removed and the surfaces of the resulting tubular structure are lightly abraded with 400 grit emery paper until the surface is uniformly dull. The structure is cleaned in detergent and mild hydrochloric acid solutions, then rinsed with deionized water. An about 0.01 mil. layer of copper is applied by electroless plating then the copper layer is increased to about 0.01 in. in an electrolytic plating bath. The structure is then dipped in a bath of fused metal at about 170° F, the bath consisting of about 50.0 wt% bismuth, 26.7 wt% lead, about 13.3 wt% tin and about 10.0 wt% cadmium. The structure is removed and rapidly spun about an axis perpendicular to the tube axis while the structure is cooled to solidify the metal coating producing an overcoating having a thickness of about 0.6 mil. Tests in a high relative humidity environment show that the coating is substantially completely impervious to moisture.

EXAMPLE VI

A quantity of Whittaker Morgan's Modmor I high-modulus graphite fibers are placed in a rectangular mold with the fibers randomly arranged. The fiber mat is impregnated with Monsanto's SC-1008 phenolic resin, the mold is closed and the resin is cured for about 2 hours at about 350° F under moderate pressure. The resulting plate-like structure is uniformly abraded by spraying it with fine silicon carbide particles in a dry air stream until the structure surface is uniformly dull. The structure is cleaned and placed in a conventional cathode-sputtering chamber and a 0.00035 inch layer of copper is applied by cathode sputtering. The structure is immediately transferred to a conventional vacuum evaporation chamber, where four 0.05 mil. layers of tin and four 0.05 mil. layers of indium are alternately coated over the copper undercoat. The structure is removed and immediately dipped in a hot oil bath at about 280° F until the overcoat fuses. The structure is removed from the oil and wiped with an air knife as the overcoat metal layer solidifies. Long term exposure to high humidity results in no moisture absorption.

The materials and physical variables used in the above examples illustrate certain specific preferred embodiments of the present invention. Other suitable materials and process steps, as described above, may be used with similar results. In addition, other materials may be added to the undercoat or overcoat, or other layers added, to synergize, enhance or otherwise modify the properties of the system.

Other modifications and ramifications of the present invention will occur to those skilled in the art upon reading the present disclosure. These are intended to be included within the scope of this invention, as defined in the appended claims.

I claim:

1. A moisture impervious composite structure comprising:

a structure comprising fibers embedded in a synethetic resin matrix;

an adherent metallic undercoating covering the surface of said structure;

a uniform, non-porous, moisture impervious fusible metal top coat covering the surface of said undercoat, said top coat solidified from a fused state in place over said undercoat;

said top coat being substantially free of open paths between its surfaces.

2. The structure according to claim 1 wherein said fibers comprise graphite fibers.

3. The structure according to claim 1 wherein said undercoat comprises copper and said top coat comprises a mixture of from about 48 to about 52 weight percent tin and from about 52 to about 48 weight percent indium.

4. The structure according to claim 3 wherein said undercoat has a thickness of from about 0.00025 to about 0.00035 inch and said top coat has a thickness of from about 0.2 to about 0.6 mil.

5. The method of forming a moisture impervious coating on composite structures which comprises the steps of:

providing a composite structure comprising fibers embedded in a synthetic resin matrix;

forming a metal undercoating over the structure surface;

forming a top coat substantially free of open paths between its surfaces over said undercoat by solidifying a fused metal coating from an entirely fused state in place on said undercoat, said fused metal having a fusion temperature below the temperature at which degradation of said synthetic resin occurs.

6. The method according to claim 5 further including the step of uniformly abrading the surface of said structure prior to the formation of said metal undercoating.

7. The method according to claim 5 further including the step of cleaning the surface of said metal undercoating prior to the formation of said top coat.

8. The method according to claim 5 wherein said under-coating is formed by plating by electroless and electrolytic techniques a metal selected from the group consisting of copper, nickel chromium, silver and mixtures and multi-layers thereof.

9. The method according to claim 8 wherein said metal is copper plated to a thickness of from about 0.00025 to about 0.00035 inch.

10. The method according to claim 5 wherein said top coat comprises an eutectic mixture of at least two members of the group consisting of bismuth, tin, lead, indium, and cadmium.

11. The method according to claim 10 wherein said eutectic mixture comprises from about 48 to about 52 weight percent tin and from about 52 to about 48 weight percent indium.

12. The method according to claim 5 wherein said top coat is formed by directly contacting said structure with said fused metal in a fused state, to form a layer of entirely fused metal then cooling the structure to solidify the metal.

13. The method according to claim 5 further including the step of rapidly rotating said structure as said fused metal solidifies to sling off excess metal.

14. The method according to claim 5 wherein said top coat is formed by electroplating onto said undercoating at least one layer of each metal making up the top coating, heating the electroplated top coating above the fusion temperature of the top coating metals, then cooling the structure to solidify the top coating.

15. The method of forming a moisture impervious coating on composite structures whichs comprises the steps of:

providing a structure comprising graphite fibers embedded in a synthetic resin matrix material;

abrading the structure surface to produce a uniform dull surface;

forming an undercoat on said surface by electroless plating at least one metal selected from the group consisting of copper, nickel chromium, silver, mixtures thereof and multi-layers thereof;

assuring a clean surface on said undercoat;

forming a top coat over said undercoat by solidifying a fused metal coating in place on said undercoat, said fused metal coating comprising an eutectic mixture of at least two metals selected from the group consisting of bismuth, tin, lead, cadmium, and indium, the fusion temperature of said eutectic mixture being below the temperature at which damage to said synthetic resin matrix occurs.

16. The method according to claim 15 wherein said top coat is formed by directly contacting said undercoat with fused metal, shaping the fused metal to a uniform coating of a selected thickness and solidifying the fused metal.

17. The method according to claim 15 wherein said top coat is formed by electroplating at least one layer of each of said at least two metals onto said undercoat, heating the electroplated top coat above the fusion temperature of said at least two metals, and solidifying the resulting fused metal top coat.

* * * * *